US009878334B2

(12) United States Patent
Massa

(10) Patent No.: US 9,878,334 B2
(45) Date of Patent: Jan. 30, 2018

(54) SPRAY NOZZLE DEVICE AND COATING METHOD

(71) Applicant: EV GROUP E. THALLNER GMBH, St. Florian am Inn (AT)

(72) Inventor: Felix Massa, Scharding (AT)

(73) Assignee: EV GROUP E. THALLNER GMBH, St. Florian am Inn (AT)

( * ) Notice: Subject to any disclaimer, the term of this patent is extended or adjusted under 35 U.S.C. 154(b) by 26 days.

(21) Appl. No.: 14/652,539

(22) PCT Filed: Dec. 11, 2013

(86) PCT No.: PCT/EP2013/076269

§ 371 (c)(1),
(2) Date: Jun. 16, 2015

(87) PCT Pub. No.: WO2014/102063

PCT Pub. Date: Jul. 3, 2014

(65) Prior Publication Data

US 2015/0314308 A1 Nov. 5, 2015

(30) Foreign Application Priority Data

Dec. 27, 2012 (DE) ..... 10 2012 113 124

(51) Int. Cl.
*B05B 1/30* (2006.01)
*B05B 1/26* (2006.01)
(Continued)

(52) U.S. Cl.
CPC ..... *B05B 1/30* (2013.01); *B05B 1/267* (2013.01); *B05B 7/0815* (2013.01);
(Continued)

(58) Field of Classification Search
None
See application file for complete search history.

(56) References Cited

U.S. PATENT DOCUMENTS 3,970,249 A 7/1976 Singer
4,064,295 A 12/1977 Singer ..... 427/424
(Continued)

FOREIGN PATENT DOCUMENTS

CN 101291739 A 10/2008 ..... B05B 7/08
CN 201404872 Y 2/2010 ..... B05B 7/08
(Continued)

OTHER PUBLICATIONS

International Search Report issued in corresponding International Patent Application No. PCT/EP2013/076269, dated Mar. 7, 2014.
(Continued)

*Primary Examiner* — Nathan T Leong
(74) *Attorney, Agent, or Firm* — Kusner & Jaffe

(57) ABSTRACT

A spray nozzle apparatus for spraying a spray jet which contains a coating material in one spray direction S for coating of a surface which is located in the spray direction S opposite the spray nozzle apparatus transversely to the spray direction S with a spray nozzle for spraying the spray jet from a spray nozzle outlet of the spray nozzle and at least one control nozzle with a control nozzle outlet which is aligned or can be aligned to the spray jet transversely to the spray direction S for acting on the spray jet and deflecting it by means of a control flow which is emerging from the control nozzle outlet, characterized in that there is one control apparatus for control of the control flow with a control signal.

12 Claims, 2 Drawing Sheets

(51) Int. Cl.

| | |
|---|---|
| ***B05B 7/08*** | (2006.01) |
| ***B05B 12/12*** | (2006.01) |
| ***B05D 1/02*** | (2006.01) |
| *B05D 3/04* | (2006.01) |
| *B05B 5/04* | (2006.01) |
| *B05B 15/04* | (2006.01) |
| *B05B 17/06* | (2006.01) |

(52) U.S. Cl.
CPC ..... *B05B 12/122* (2013.01); *B05D 1/02* (2013.01); *B05B 5/0426* (2013.01); *B05B 15/0431* (2013.01); *B05B 17/06* (2013.01); *B05D 3/042* (2013.01)

(56) References Cited

U.S. PATENT DOCUMENTS

| | | | | |
|---|---|---|---|---|
| 4,854,504 | A | 8/1989 | Hedger, Jr. et al. | 239/294 |
| 5,344,078 | A | 9/1994 | Fritz et al. | 239/296 |
| 5,429,682 | A | 7/1995 | Harlow, Jr. et al. | |
| 5,429,840 | A | 7/1995 | Raterman et al. | |
| 5,579,998 | A | 12/1996 | Hall et al. | 239/9 |
| 5,645,884 | A * | 7/1997 | Harlow, Jr. | B05B 12/02 427/424 |
| 5,689,415 | A | 11/1997 | Calotychos et al. | 364/172 |
| 5,800,867 | A | 9/1998 | Matsunaga et al. | 427/236 |
| 2004/0124270 | A1 | 7/2004 | Zhou | 239/399 |
| 2005/0284957 | A1 | 12/2005 | Haruch | 239/290 |
| 2006/0257581 | A1 | 11/2006 | Wulteputte | |
| 2010/0078496 | A1 * | 4/2010 | Massimi | B05B 7/0815 239/4 |
| 2010/0276507 | A1 | 11/2010 | Labegorre et al. | 239/11 |
| 2013/0161413 | A1 | 6/2013 | Funseth et al. | |

FOREIGN PATENT DOCUMENTS

| | | | | |
|---|---|---|---|---|
| CN | 101909761 | A | 12/2010 | B05B 1/04 |
| CN | 201815411 | U | 5/2011 | B05B 7/08 |
| DE | 24 52 684 | C2 | 5/1975 | |
| DE | 27 49 369 | A1 | 5/1979 | |
| DE | 691 26 019 | T2 | 11/1997 | |
| DE | 69715741 | T2 | 7/2003 | B05B 7/08 |
| DE | 103 92 799 | B4 | 3/2007 | |
| EP | 0192383 | A2 | 8/1986 | B05B 7/16 |
| EP | 0 710 506 | A1 | 5/1996 | B05B 7/08 |
| EP | 0 710 506 | B1 | 6/1997 | B05B 7/08 |
| EP | 0819473 | A1 | 1/1998 | B05B 7/08 |
| EP | 2145695 | A1 | 1/2010 | B05B 7/08 |
| GB | 2 007 878 | A | 5/1979 | |
| JP | S50-129439 | A | 10/1975 | |
| JP | S54-72319 | A | 6/1979 | |
| JP | H06-248990 | A | 9/1994 | |
| JP | H07-508923 | A | 10/1995 | |
| JP | H07-299389 | A | 11/1995 | |
| JP | 2992760 | B2 | 10/1999 | |
| JP | 2004-10023 | A | 1/2004 | |
| JP | 2008-544836 | A | 12/2008 | |
| WO | WO-91/12088 | A1 | 8/1991 | |
| WO | WO 94/01222 | | 1/1994 | B05B 1/26 |
| WO | WO-03/106204 | A1 | 12/2003 | |

OTHER PUBLICATIONS

James et al., *Handbook of Polymer Coatings for Electronics,* Dec. 31, 1990, p. 162.

Nasr, G. G. et al., *Industrial Sprays and Atomization, Design, Analysis and Applications,* Dec. 31, 2002.

Chinese Office Action issued in corresponding Chinese Patent Application No. 201380068704.6 dated Aug. 3, 2016.

* cited by examiner

SPRAY NOZZLE DEVICE AND COATING METHOD

RELATED APPLICATIONS

This application is a National Stage of International Application No. PCT/EP2013/076269 filed Dec. 11, 2013, which claims the benefit of German Patent Application No. 102012113124.4, filed Dec. 27, 2012.

FIELD OF THE INVENTION

This invention relates to a system, a spray nozzle, and a method for homogeneous spray lacquering of large-area substrates.

BACKGROUND OF THE INVENTION

Various coating methods are used in the semiconductor industry, such as centrifugal coating and spray coating.

In centrifugal coating, a substance to be applied is deposited on a substrate in liquid form. Afterwards, the substrate is set into rotation. The rotation generates the action of a force on the liquid and distributes it over the entire surface of the substrate. By a dedicated choice of the coating parameters, primarily the rotational speed and rotational acceleration of the carrier substrate, layer thicknesses from a few nanometers to a few micrometers, and in extreme cases even a few millimeters, can be produced. The centrifugal coating is used primarily for coating of flat surfaces with a resist or cement which is used in the semiconductor industry for cementing of several substrates. The advantage lies in the very precise, prompt, efficient and economical application of the material. The disadvantage of centrifugal coating appears, however, in structured substrates or very large substrates. Structured substrates lead to a relatively inhomogeneous thickness of the layer to be applied, mainly when the target layer thickness is smaller than the highest topographies on the substrate. In this respect, as a result of the material being distributed from the inside to the outside, only the side walls of the topographies oriented to the center are coated with the material, and conversely bubbles or faults form in the material on the sides facing away from the center. Another disadvantage of centrifugal coating consists mainly in the maximum size and limitation with respect to the geometrical shape of the substrates which are to be coated. Standardized substrates, primarily wafers, in most cases silicon wafers, have a round, therefore radially symmetrical symmetry and a standardized diameter. In the past substrates with diameters from two to twelve inches were used. In the future, substrates with diameters of up to eighteen inches will probably be used in the semiconductor industry. In addition, there are very many branches of industry which are dependent on coating rectangular substrates which are many times larger than the indicated radially symmetrical substrates. For example, in the solar industry, substrates, i.e., panels must be coated. These panels are not round and would not fit into a conventional coating system for centrifugal coating. In this respect, the panels are rectangular substrates whose length and/or width is/are often greater than two meters. Their thickness is in the millimeter to centimeter range. Similar problems arise for all types of substrates, generally glass substrates, which are used for windows, displays, windshield, etc.

One possibility for the coating of these panels is spray coating. With a correspondingly designed system for spray coating, the panels, preferably even in an assembly line process, are coated over the entire surface with any material. The deciding criterion for optimum coating is mainly the homogeneity of the layer thickness. The panel must be coated with a material over its entire area, which area is not small for the use of spray coating systems. The layer thickness of the deposited layer must often be in the micrometer or even nanometer range. Industry has already found different approaches for corresponding situations. Thus, several nozzles can be distributed along the entire width of a corresponding spray coating system, wherein each nozzle coats only a small strip of the panel which lies directly under it. In this arrangement, the problem arises that the finely atomized particles agglomerate along the "interfaces" at which the coating areas of the nozzles intersect. As a result, a homogeneous layer thickness of the layer cannot be assumed. Another already implemented possibility consists in using one or more nozzles which move back and forth along a rail along the entire width of the coating system over the panel to be coated. This version definitively produces a layer with a more homogeneous layer thickness than in the first configuration, but it is comparatively slow and is not suited for a high throughput. The bearing units, the rail and the carriages on which the nozzle is fastened are accordingly movable and thus susceptible to wear and high failure probabilities. Corresponding vibrations and/or turbulence, which massively influence the homogeneity of the layer, are formed by the movement of the nozzles.

US 2010/0078496 shows a spray nozzle apparatus in which a spray mist of a corresponding spray coating system is deflected.

The goal of this invention is to devise a spray nozzle apparatus and a corresponding system and a method for operating a spray nozzle apparatus with which a more homogeneous coating is enabled.

This goal is achieved with the features of the claims. Advantageous developments of the invention are given in the dependent claims. All combinations of at least two of the features given in the specification, the claims and/or in the figures fall within the scope of the invention. For given values ranges, values which lie within the indicated limits should be considered disclosed as boundary values and able to be claimed in any combination.

SUMMARY OF THE INVENTION

The invention relates to a system and a method for optimally coating a large area, especially panels, preferably solar panels, using a spray nozzle apparatus. The intention is mainly to produce a layer with an extremely homogeneous layer thickness over a substrate area which is relatively large for conventional coating systems, with a length and/or a width greater than half, preferably one to two meters. The thickness of the substrates normal, i.e., perpendicular, to the area to be coated is in the millimeter to centimeter range.

The invention is based on the concept of using several control nozzles which are aligned or can be aligned to a spray jet of the spray nozzle. The control nozzles distribute or deflect, in a controlled manner, a spray mist or an aerosol, i.e., a mixture of liquid particles and/or solid particles in a gas, along a line, or a strip-shaped area, a rectangle, by means of a special swirl technique even over a circular area, but in general, along any area. The substrate to be coated is moved in translation in direction R during the activation of the spray mist by the control nozzles along a path normal to the spray direction or transversely to the spray direction or transversely to the alignment of the spray nozzle, i.e., is drawn through under the spray mist.

Preferably, a non-rotatable spray nozzle is used which is static at least in one direction transversely to the relative movement between the substrate to be coated and the spray nozzle with reference to the system. In this way, the construction of the system becomes cheaper, the system is easier to maintain and the maintenance intervals become longer.

According to one advantageous embodiment of the invention, a spray nozzle apparatus is provided and has a control apparatus with separately controlled control signals for the control of the gaseous control flows emerging from the control nozzles. The control apparatus can take over other tasks, such as the control of the spray nozzle. Furthermore, it is conceivable for the control of the control nozzles and/or of the spray nozzle to take place depending on a speed of relative movement of the substrate compared to the spray nozzle. Furthermore, it is conceivable for the sensors to be coupled to the control apparatus, especially level sensors for a reservoir with coating material and/or a reservoir with a gas which is filled for acting upon the control flows. Thus, the components and flows which are important for the coating can be controlled depending on one another, as a result of which, a more homogeneous coating of the substrate is enabled. The spray nozzles and/or the control nozzles are operated with voltages in the range of 0-1000 V, preferably 0-500 V, more preferably 0-250 V, most preferably 0-200 V, even more preferably 0-100 V, most preferably of all with 0-10 V.

The gas flow of the spray nozzle and/or control nozzle is between 0-1000 l/min, preferably between 0-500 l/min, more preferably between 0-250 l/min, most preferably between 0-200 l/min. The control gas for the control nozzles can generally be all types of gases and/or gas mixtures. Preferably, it is, however, one of the following gases and/or gas mixtures . . .

- nitrogen
- clean dry air (CDA)
- carbon dioxide,
- argon,
- helium,
- oxygen
- an inert gas
- a mixture of inert gases.

The gas pressure of the spray nozzles and/or control nozzles is between >0-100 bar, preferably between >0-50 bar, more preferably between >0-25 bar, most preferably between >0-10 bar, most preferably of all between >0-5 bar.

To the extent the control signals are made defined, as a function which has a phase shift, a defined, preferably softer transition takes place between the action of the respective control flow on the spray jet. It is advantageous if the phase shift takes place at least predominantly, even more completely, with destructive interference. Thus, the sum of the control signals is constant, so that a better and more uniform coating result can still be achieved.

The form/function of the control signal is preferably one of the following mathematical functions:

- empirically determined and stored function,
- theoretically defined function
- sinusoidal function
- sawtooth function
- rectangular function
- Dirac delta function ("infinitely" narrow rectangular signal)
- exponential function
- polynomial function
- logarithmic function The "empirically determined and stored function," which is first in the above list and therefore the most preferred, is defined as a control signal which has been optimized by empirical measurements of the layer thickness or layer thickness distribution of the coating and which cannot be prepared by theoretical considerations. It would, for example, be conceivable for a number of substrates to be coated under certain initial and boundary conditions. A subsequent evaluation of the layer allows conclusions regarding whether the control signals which have been used have delivered the desired result. If this is not the case, the initial and/or boundary conditions, therefore the control signals, are changed accordingly and the coating process is repeated. If deterioration is ascertained, the optimization process of the control signals will be continued accordingly until the desired optimized result prevails. The desired control signal is generally not described by a trivial mathematical function, but by any advantageously objective function and can be digitally stored.

A "general, theoretically devised function" is defined as any function which is known to mathematics and which however seems necessary and/or useful by physical and/or chemical and/or process engineering and/or mathematical considerations to be able to optimally carry out the method. A superposition of several functions is also conceivable.

For all control signals, but especially for the "empirically determined and stored" function and the "general, theoretically devised function", the goal is to compensate by the signal shape for as many disruptive influences as possible which lead to a nonuniform coating. Possible causes for a nonuniform coating can be the following, among others:

- production tolerances of different components of the spray apparatus
- substrate properties
- properties of the spray nozzle
- physical effects (the deflection of the spray jet in non linearly to the signal function [sic])
- properties of the spray material (for example droplet size, viscosity, etc . . . )

The frequency of the control signals is between >0 and 500 Hz, preferably between >0 and 400 Hz, more preferably between >0 and 300 Hz, most preferably between >0 and 200 Hz, still more preferably between >0 and 100 Hz, most preferably of all between >0 and 50 Hz.

The lacquering agent used can be liquid and/or gaseous. Preferably, it is a liquid which is atomized by corresponding atomizers, preferably ultrasonic atomizers, in the spray nozzle. Any additives in gaseous and/or liquid form can be added to the lacquering agent.

The power of the ultrasonic atomizer is between >0 and 100 watt, preferably between >0 and 50 watt, more preferably between >0 and 25 watt, most preferably between >0 and 10 watt, most preferably of all between >0 and 5 watt.

Preferably, the lacquering agent is a lacquer. The deposition rate of the lacquering agent is between 1 and 1000 μl/s, preferably between 1 and 800 μl/s, more preferably between 1 and 600 μl/s, most preferably between 1 and 500 μl/s. The triggering of the control nozzles can be implemented advantageously by mechanical and/or fluid dynamic components which can be switched by the control signals for influencing the flow properties of the control flows.

The spray nozzle is improved by an embodiment in which the spray nozzle is made static, especially unable to rotate, at least in one direction transversely to the relative motion between the substrate which is to be coated and the spray nozzle relative to the system. In particular, the spray nozzle apparatus has fixing means with which the spray nozzle apparatus can be fixed. In particular, during the coating, the spray nozzle has no degrees of freedom in one direction transversely to the relative motion of the substrate compared to the spray nozzle. Thus, drive means or drive coupling means on the spray nozzle apparatus can be omitted.

The spray nozzle is developed by its encompassing an ultrasonic atomizer and/or a Venturi nozzle.

According to a further advantageous embodiment of the invention, it is provided that the control flows are aligned at an angle W from 30° to 170°, in particular from 45° to 160°, preferably from 90° to 120° to the spray direction S to the spray jet. Preferably, the angle of alignment can be set within the aforementioned boundaries, preferably controlled via the control apparatus.

The opening angle $\alpha$ of the control nozzle and/or the opening angle $\beta$ of the spray nozzle is smaller than 160°, preferably smaller than 120°, more preferably smaller than 80°, most preferably smaller than 40°, most preferably of all smaller than 5°. The opening angles $\alpha$ and $\beta$ can be different from one another or the same. According to one advantageous embodiment, each opening angle of each control nozzle can be set individually and independently of the opening angles of all other control nozzles by the control apparatus.

The distance H of the spray nozzles and/or control nozzles over the substrate to be coated is between >0 and 100 cm, preferably between >0 and 80 cm, more preferably between >0 and 60 cm, most preferably between >0 and 50 cm, most preferably of all between >0 and 40 cm.

The layer thicknesses, which are produced with the embodiment, are between 1 nm and 1 mm, preferably between 10 nm and 100 μm, more preferably between 50 nm and 50 μm, most preferably between 75 nm and 250 nm, most preferably of all around 110 nm.

The uniformity is between 1% and 30%, preferably between 1% and 25%, more preferably between 1% and 20%, most preferably between 1% and 15%, even more preferably between 1% and 10%, most preferably of all between 1% and 5%.

As an independent invention, a system for coating of a surface of a substrate using a single, above-described spray nozzle apparatus is also disclosed. The system has means for executing the relative motion between the substrate and the spray nozzle apparatus transversely to the spray direction S. Preferably, the substrate is moved while the spray nozzle apparatus is statically fixed in the system, at least in one direction transversely to the relative movement between the substrate which is to be coated and the spray nozzle.

The system is developed by the relative movement taking place by translational movement of the substrate in the direction R.

In one special embodiment, which relates to an independent aspect of the invention, there are several sensors in front or and/or behind the spray nozzle apparatus. The sensors are preferably located along a line, normal to the direction R of movement of the substrate. The task of the sensors is to measure physical and/or chemical properties of the surface and/or the layer which is present upstream and/or downstream of the spray nozzle apparatus.

The sensors which scan the surface parts of the substrate before they are pulled under the spray nozzle apparatus as claimed in the invention are called upstream sensors. The sensors which scan the surface parts of the substrate after they have been coated by the spray nozzle apparatus as claimed in the invention are called downstream sensors.

The upstream sensors determine the state of the surface of the surface parts before lacquering. The determined value can be digitally stored, preferably by means of corresponding software of a control computer. The determined physical quantities are acquired preferably with reference to a coordinate system which is fixed relative to the substrate.

The downstream sensors determine the state of the surface of the surface parts after lacquering/coating. The determined values can likewise be digitally stored.

In a still more preferred embodiment, the downstream sensors determine the layer which has been produced by the spray nozzle apparatus, and match the control signals to the spray nozzle apparatus until the desired homogeneity has been reached. In doing so, optimization algorithms are used, which are known to one skilled in the art in the field. The mentioned embodiment is therefore a fully automatic, in-situ adaptation of the control signals to the spray nozzle apparatus.

The upstream and/or downstream sensors therefore form a control loop, at least during the calibration process. The sensors measure the state of the layer. The values which have been determined from them adjust the control signals which in turn influence the homogeneity of the layer. The control loop ends as soon as a threshold which has been stipulated by the user for the homogeneity has been reached.

It is clear to one skilled in the art in the field that the method of calibration disclosed here for setting a homogeneous layer can also be used for setting any layer structure which has been stipulated by the user.

Preferably, the spray nozzle apparatus is made such that the spray jet during one phase of the control signals acquires the entire coating width of the surface of the substrate. But the use of several spray nozzle apparatus, which are placed in a row and/or in series, therefore behind one another and/or next to one another, is also conceivable.

As an independent invention, a method for coating of a substrate surface which is located opposite a spray nozzle apparatus and transversely to the spray direction S by means of a spray jet which contains a coating material in one spray direction S is disclosed. The spray jet is deflected by at least two control flows which are aligned to the spray jet transversely to the spray direction S.

Therefore, more than two control nozzles can also be used, which are then preferably located symmetrically around the spray direction S.

In one special embodiment, it is even conceivable to use only one control nozzle which deflects the spray jet out of its "rest position" by a corresponding control signal only in one direction. If the control signal is then cancelled again, the spray jet passes again into its "rest position."

In another special embodiment, the control nozzles are placed and are triggered by functions such that a vortex mist can be produced. The method as claimed in the invention is developed by the control flows being controlled separately by control signals of a control apparatus.

In a development of the method, the substrate is moved relative to the spray jet during the coating of the surface, in particular in translation in the direction R.

According to one embodiment of the method, it is advantageous if the spray jet is deflected alternately in different directions which are reflected back on the spray direction, To the extent features are disclosed for the spray nozzle apparatus, they should also be considered as disclosed for the device, and to the extent method features of the spray nozzle apparatus or of the device are disclosed, they should also be considered disclosed as features for the method as claimed in the invention and vice versa.

By triggering the control nozzles by corresponding control signals, a more homogeneous deposition of the material on the surface of the substrate takes place.

Other advantages, features and details of the invention will become apparent from the following description of preferred exemplary embodiments using the drawings.

BRIEF DESCRIPTION OF THE DRAWINGS

In the figures, advantages and features of the invention are labeled with reference numbers which identify them according to embodiments of the invention, components and features with the same function and/or a function with the same action being labeled with identical reference numbers.

DETAILED DESCRIPTION OF THE PREFERRED EMBODIMENTS

Figure 1:
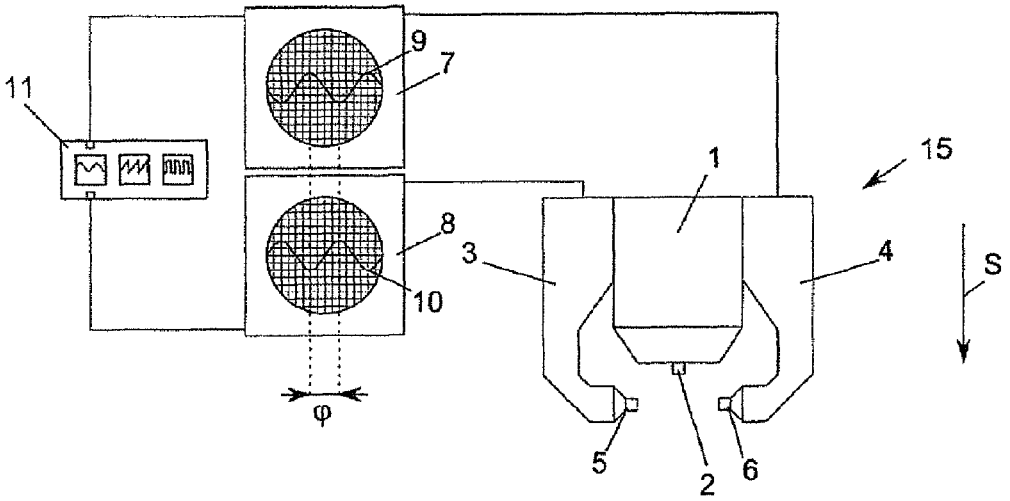
FIG. 1 shows a schematic of one embodiment of a spray nozzle apparatus according to the invention and FIG. 2 shows a schematic of the operation of the spray nozzle apparatus.

The spray nozzle apparatus 15 is comprised of a spray nozzle 1, with one spray nozzle outlet 2 and at least two control nozzles 3 and 4, with corresponding control nozzle outlets 5 and 6.

The spray nozzle 1 is supplied with a coating material which is atomized. The atomization takes place preferably with an ultrasonic atomizer or by means of a Venturi nozzle within the spray nozzle 1. The spray nozzle 1 at the spray nozzle outlet 2 produces a spray jet 14 which is directed in one spray direction S, as a spray mist whose form can be preset by a correspondingly engineered spray nozzle outlet 2.

The control nozzles 3, 4 each produce one gaseous control flow 12, 13 which emerges at the control nozzle outlets 5 and 6. The control flows 12, 13 are aligned or can be aligned to the spray jet 14.

The pressure, the atomization rate, the average velocity, the temperature, and the electric charge of the atomized coating material and/or of the gaseous control flows 12, 13 can be set and changed by the control apparatus 11 that is controlled by software. It is also contemplated to make the alignment of the control flows 12, 13 to the spray jet 14 adjustable, by means for tilting and/or rotating the control nozzles 3, 4 relative to the spray nozzle 1.

One main concept of the invention comprises the exact time monitoring of the average velocity and/or of the pressure of the control flows 12, 13 which are emerging from the control nozzles 3, 4 via the control nozzle outlets 5, 6. Control signals 9, 10 of one control apparatus of the spray nozzle apparatus 15 switch corresponding mechanical and/or fluid dynamic components within the control nozzles 3, 4. The mechanical and/or fluid dynamic components, which are not described in detail, can be control valves, proportional valves, switches, atomizers and/or throttles. Common to all is that there is one physical property which can be varied or controlled promptly in time and which has a direct effect on the average velocity and/or the pressure of the control flows 12, 13, and thus, an effect on the triggering or deflection of the atomized coating gas 14.

According to the invention, primarily complicated, empirically and/or theoretically determined or computed functions, less preferably sinusoidal signals and/or triangular signals, optionally also (especially combined with the aforementioned signals) rectangular signals are used to trigger, i.e., control, the control nozzles 5, 6, such as by means of one of the oscilloscopes 7, 8 which are assigned to one of the control nozzles at a time. Preferably, the two signals 9 and 10 have a corresponding phase difference or phase shift to one another in order to ensure a time offset of the control flows 12 and 13. In this respect, it is preferable if the phase shift of the two control signals 9, 10 has destructive interference. An extremely homogeneous coating is possible in this way.

Figure 2:
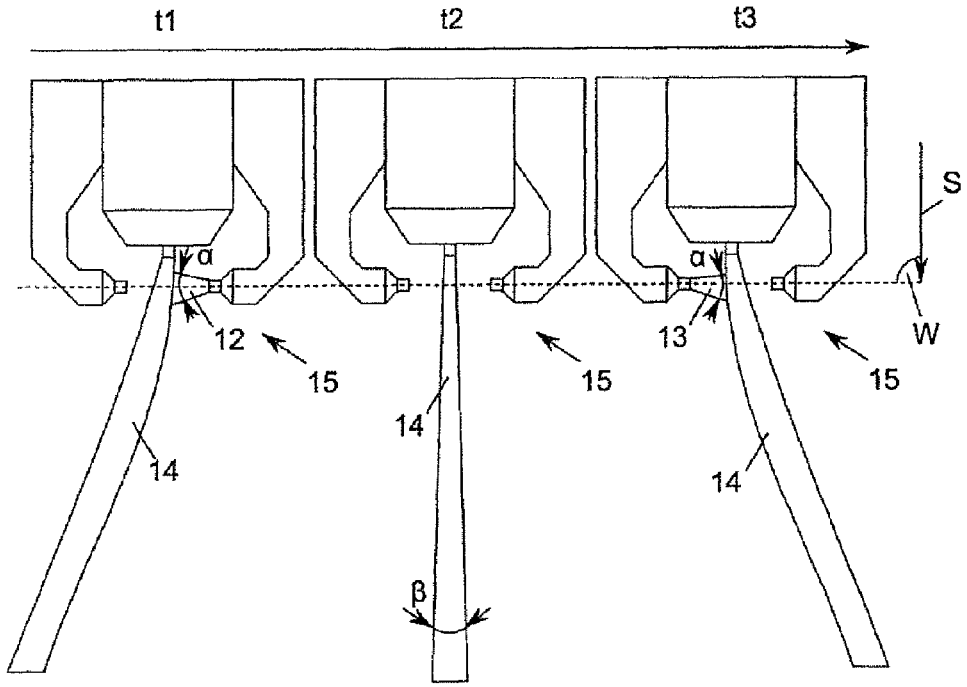

FIG. 2 shows a time line along which three different states of a spray nozzle apparatus 15 according to the invention are represented. At a first instant t1, a control flow 12 of the control nozzle 4 is used in order to deflect the spray jet 14 from the spray direction S to the left. The instant t1 shows the state in which the control signal 9 for triggering the control nozzle 4 has a maximum and the control signal 10 for triggering the control nozzle 3 has a minimum. The triggering states when a sinusoidal signal is injected would be for example a maximum value and a minimum value of the sinusoidal signal.

At a second instant t2, the control signals 9 and 10 are equal, in particular, equal to 0 so that on the two control nozzles 5, 6 no control flows 12, 13 or control flows 12, 13 which mutually cancel are acting on the spray jet 14. The spray jet 14 can therefore move unhindered normally to the surface which is to be coated, therefore in the spray direction S.

At a third instant t3, the situation which was reversed at instant t1 occurs, in which the control nozzle 3 causes the deflection of the spray jet 14 to the right.

According to the invention, a signal which is continuous over the entire definition range is used to continuously change the flow properties, especially the average velocity and/or volumetric flow, of the control flows 12 and 13. Accordingly, the three instants which are shown in FIG. 2 represent only extracts from a number of instants which is infinite in the boundary case, and for which the control signals 9 and 10 cause a continuous control of the control flows 12 and 13.

In other words, the spray jet 14 is deflected alternately to the left and right by the arrangement and alignment of the control flows 12, 13 which is opposite relative to the spray direction S as a mirror axis so that a homogeneous distribution of the coating material on the surface of the substrate 17 results.

Softer control signals which produce a more homogeneous layer, and thus, which are superior to the embodiments of the prior art are introduced by the embodiment. The control signals are therefore described, from a mathematical standpoint, by continuous, preferably even continuously differentiable, more preferably continuous, continuously differentiable functions.

The substrate 17 which is to be coated during the triggering of the control nozzles 3 and 4 is passed under the spray jet 14 in one direction R so that the substrate 17 can be coated along the entire substrate 17. Moreover, the invention encompasses a larger section A of width B of the substrate 17 so that with a single spray apparatus which is static relative to the system, a relatively large area can be homogeneously coated. In particular, the section A corresponds to the width B.

A distance H between the spray nozzle apparatus 15 and an area of the substrate 17 to be coated in the normal direction to the area, i.e., in the spray direction S, can be controlled. The distance H is smaller than the section A.

Figure 3:
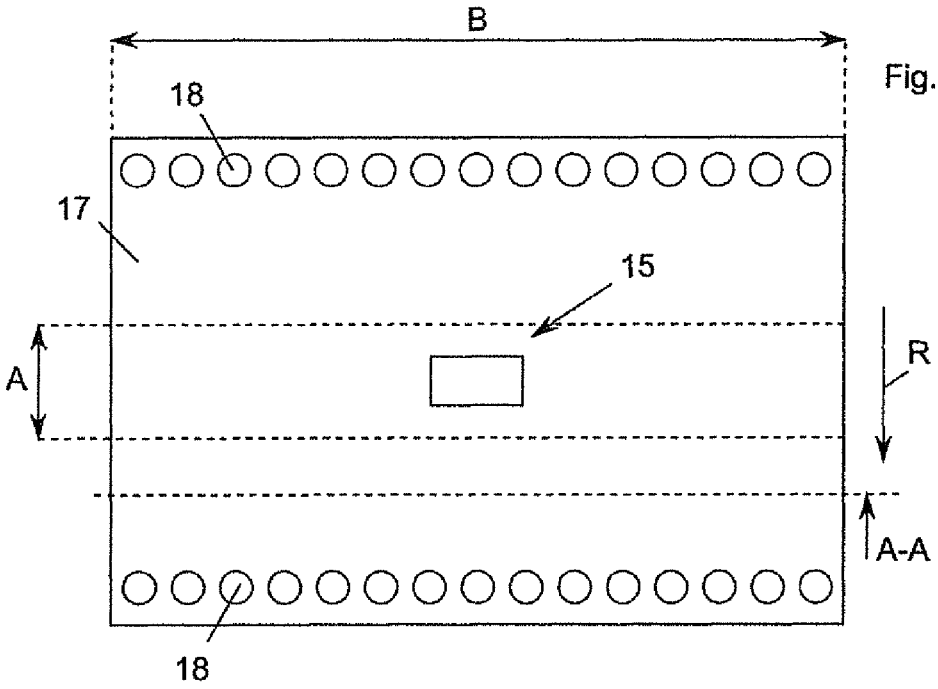
FIG. 3 shows a schematic of a system according to the invention from above.
Figure 4:
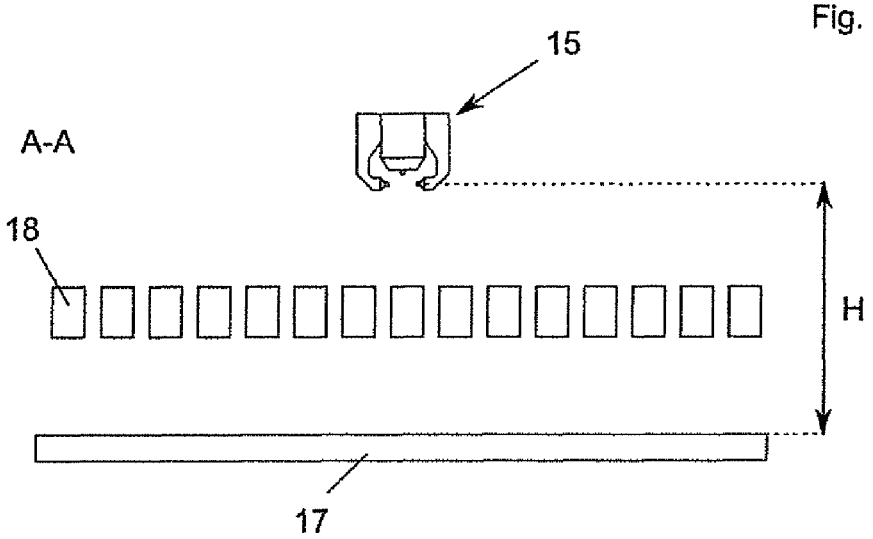
FIG. 4 shows a schematic of a system according to the invention in a side view.

According to FIG. 3, there are several sensors 18 in the direction R upstream and/or downstream of the spray nozzle apparatus 15. The sensors 18 are arranged preferably flush with one another normal, i.e., perpendicular, to the direction R of movement of the substrate 17, in the spray direction at a uniform height between the spray apparatus 15 and the area which is to be coated.

The sensors 18 are designed to measure physical and/or chemical properties of the area to be coated upstream and/or downstream of the spray nozzle apparatus 15.

The sensors 18 which are located upstream of the spray nozzle apparatus 15 determine the state of the surface of area parts prior to coating.

After coating, the sensors which are located downstream of the spray nozzle apparatus 15 determine the state of the area or area parts which were to be coated.

REFERENCE NUMBER LIST

1 spray nozzle
2 spray nozzle outlet
3 control nozzle
4 control nozzle
5 control nozzle outlet
6 control nozzle outlet
7 oscilloscope
8 oscilloscope
9 control signal
10 control signal
11 control apparatus
12 control flow
13 control flow
14 spray jet
15 spray nozzle apparatus
17 substrate
18 sensors
H distance between spray nozzle and substrate
R direction of motion
α opening angle
β opening angle
A section
B width Having described the invention, the following is claimed:

1. A spray nozzle apparatus for coating a surface that is located in a spray direction S opposite the spray nozzle apparatus transversely to the spray direction S, the apparatus comprising:

a spray nozzle that is statically fixed relative to movement of the surface to be coated, the spray nozzle comprising a spray nozzle outlet, the spray nozzle being configured to spray a spray jet containing a coating material in the spray direction S from the spray nozzle outlet, the spray nozzle being unable to rotate at least in one direction transversely to relative movement between the surface to be coated and the spray nozzle, at least two control nozzles, each of the control nozzles comprising a control nozzle outlet aligned to the spray jet transversely to the spray direction S, each of the control nozzles being configured to produce a control flow from the control nozzle outlet to act on and deflect the spray jet, and a control apparatus from which separately controlled control signals are provided to control the control flows, wherein a frequency of the control signals is between >0 and 500 Hz.

2. The spray nozzle apparatus as claimed in claim 1, wherein the control apparatus is software-supported to control the control flows from the control nozzle outlets, the control flows being gaseous control flows.

3. The spray nozzle apparatus as claimed in claim 1, wherein each of the control signals has a phase shift with destructive interference.

4. The spray nozzle apparatus as claimed in claim 1, wherein the control nozzles have mechanical and/or fluid dynamic components that are switchable by the control signals to influence flow properties of the control flows.

5. The spray nozzle apparatus as claimed in claim 1, wherein the spray nozzle further comprises an ultrasonic atomizer and/or a Venturi nozzle.

6. The spray nozzle apparatus as claimed in claim 1, wherein the control flows are aligned at an angle W from 30° to 150° to the spray direction S to the spray jet.

7. The spray nozzle apparatus as claimed in claim 1, wherein the control apparatus is further configured to tilt and/or rotate the control nozzles relative to the spray nozzle to adjust alignment of the respective control flows to the spray jet.

8. A system for coating of a surface of a substrate with a single spray nozzle apparatus, the surface being located in a spray direction S opposite the spray nozzle apparatus transversely to the spray direction S, the system having:

a spray nozzle apparatus configured to coat the surface of the substrate, the surface being located in a spray direction S opposite the spray nozzle apparatus transversely to the spray direction S, the apparatus comprising:

a spray nozzle that is statically fixed relative to movement of the surface to be coated, the spray nozzle comprising a spray nozzle outlet, the spray nozzle being configured to spray a spray jet containing a coating material in the spray direction S from the spray nozzle outlet, the spray nozzle being unable to rotate at least in one direction transversely to relative movement between the surface to be coated and the spray nozzle, at least two control nozzles, each of the control nozzles comprising a control nozzle outlet aligned to the spray jet transversely to the spray direction S, each of the control nozzles being configured to produce a control flow from the control nozzle outlet to act on and deflect the spray jet, means for executing relative motion between the substrate and the spray nozzle apparatus transversely to the spray direction S, and a control apparatus from which separately controlled control signals are provided to control the control flows, wherein a frequency of the control signals is between >0 and 500 Hz.

9. The system as claimed in claim 8, wherein the relative motion takes place by translational movement of the substrate.

10. The system as claimed in claim 8, wherein the control apparatus is configured to tilt and/or rotate the control nozzles relative to the spray nozzle to adjust alignment of the respective control flows to the spray jet.

11. A system for coating a surface, comprising:

a spray nozzle that is statically fixed relative to movement of the surface to be coated, the spray nozzle having a spray nozzle outlet for creating a spray jet of a coating material, said spray jet directed in a spray direction S toward the surface, said surface being oriented transversely to said spray direction S, the spray nozzle being unable to rotate at least in one direction transversely to relative movement between the surface to be coated and the spray nozzle;

at least two control nozzles each having a control nozzle outlet, said control nozzles disposed relative to said spray nozzle such that said control nozzle outlets are alignable transversely to said spray direction S;

means for creating a control flow from each of said control nozzle outlets to act on and deflect the spray jet; and a control apparatus generating a control signal for each of said control nozzle outlets for controlling the control flow from each of said control nozzle outlets, wherein each control signal has a frequency between >0 and 500 Hz.

12. The system as claimed in claim 11, wherein the control apparatus is configured to tilt and/or rotate the control nozzles relative to the spray nozzle to adjust alignment of the control flow from each of said control nozzle outlets to the spray jet.

* * * * *